US005505169A

United States Patent [19]

Mummert et al.

[11] Patent Number: 5,505,169

[45] Date of Patent: Apr. 9, 1996

[54] ELECTRIC ENGINE STARTER

[75] Inventors: Jeffrey L. Mummert; David A. Fulton; Timothy C. Monnier; Ross A. Gresley, all of Anderson, Ind.

[73] Assignee: Delco Remy America, Inc., Anderson, Ind.

[21] Appl. No.: 93,489

[22] Filed: Jul. 19, 1993

[51] Int. Cl.[6] ..... F02N 11/00

[52] U.S. Cl. ..... 123/179.3; 74/7 A; 74/7 C; 290/38 R; 290/48

[58] Field of Search ..... 123/179.3, 179.25; 290/38 R, 48; 74/7 C, 7 E, 7 A

[56] References Cited

U.S. PATENT DOCUMENTS

| | | | |
|---|---|---|---|
| 3,866,960 | 2/1975 | Chohan | 123/179.3 |
| 4,592,243 | 6/1986 | Katoh et al. | 74/7 E |
| 4,707,616 | 11/1987 | Ogle et al. | 290/48 |
| 4,862,027 | 8/1989 | Isozumi et al. | 290/48 |

FOREIGN PATENT DOCUMENTS

| | | | |
|---|---|---|---|
| 339379 | 7/1921 | Germany | 290/38 R |

*Primary Examiner*—Andrew M. Dolinar
*Attorney, Agent, or Firm*—Ice Miller Donadio & Ryan

[57] ABSTRACT

An electric starter for an internal combustion engine has a coaxial pinion drive mechanism for urging the pinion gear into a positively fully meshed arrangement with the flywheel of the internal combustion engine prior to full power application to the cranking motor. The pinion drive mechanism is incompressible throughout its motion. The drive solenoid has a solid plunger which is limited in its stroke corresponding to the fully meshed position of the pinion gear by a pair of electrical contacts which are shorted at full stroke by the plunger functioning as a contact therebetween. The cranking motor is operated at a slow rotation at all times prior to full meshing of the pinion gear to aid in meshing thus reducing tooth wear and gear lash.

9 Claims, 2 Drawing Sheets

ELECTRIC ENGINE STARTER

BACKGROUND OF THE INVENTION

This invention is related to electric starter systems for internal combustion engines.

Dual axis electric starters are known which have a solenoid aligned along a first axis and an electric cranking motor and pinion gear aligned with each other along a second axis. Single axis electric starters are also known which coaxially align a solenoid, electric cranking motor and pinion gear. Hybrid forms of these electric starters have also been shown where a solenoid and pinion gear share a common axis and a cranking motor is aligned along a separate axis.

Dual axis electric starters conventionally have a crank motor shaft supported at both ends for stability. Toward an output end of the shaft is the pinion gear and over-run clutch which are coupled so as to slide axially along the shaft together. Complimentary helical splines on the shaft and a portion of the clutch transfer rotation from the shaft to the clutch and on to the pinion gear when the clutch is engaged. The solenoid when energized causes the pinion gear to slide to a travel stop, the rectilinear motion of the solenoid being transferred to the clutch via a pivotal shift lever. The solenoid plunger also carries a moving contact intended to close a switch (via a pair of stationary contacts) for application of full power to the cranking motor when the pinion gear is fully engaged with the flywheel of the engine. This arrangement as described above requires use of longer output shafts and dead clearance space for the clutch, pinion gear and related shifted components in as much as the bulk and travel of the components dictates. Some electric starters of this type also include planetary speed reduction gears which may also add to the overall length and bulk of the starter. Additionally, tolerance stack-up of components does not readily allow for the movable contact to be net with the solenoid plunger. Rather, spring elements are conventionally utilized to allow some axial movement of the contact relative the plunger to ensure switch closure when the pinion reaches the travel stop. This arrangement may cause closure of the solenoid switch prior to the pinion gear being fully meshed with the flywheel at the travel stop leading to abrupt application of full power to the cranking motor prematurely with regard to gear meshing. The situation wherein the pinion gear crashes into the flywheel without becoming engaged therewith has been addressed by allowing the solenoid to continue its stroke by another spring arrangement between the clutch housing and pinion or between the solenoid plunger and pivotal shift lever. This arrangement is intended to allow the solenoid switch to close and apply full power to the cranking motor which rotates allowing the pinion gear to mesh with the fly wheel. Damage to gear teeth may occur with these arrangement where immediate meshing does not occur or only partial meshing occurs.

Single axis (coaxial) electric starters, such as disclosed in U.S. Pat. No. 4,923,229, have a hollow cranking motor shaft, a solenoid at the rear thereof and an over-run clutch driven thereby directly or through a planetary reduction gear mechanism. The over-run clutch imparts rotation to a clutch collar which in turn imparts rotation to a pinion shaft surrounded thereby through cooperating helical splines. The pinion shaft carries a pinion gear at the outside end. The solenoid imparts rectilinear motion to the pinion shaft to urge the shaft and pinion gear carried thereby forward through the clutch collar until it reaches a stop. The solenoid plunger is linked to the pinion shaft through the hollow cranking motor shaft via a drive rod cooperating within a hollow drive tube in telescoping arrangement. Helical springs are located between the pinion gear and pinion shaft, pinion shaft and clutch collar and within the hollow drive tube urging the drive tube and drive rod to a fully extended relationship. The solenoid plunger also carries a moving contact intended to close a switch (via a pair of stationary contacts) for application of full power to the cranking motor when the pinion gear is fully engaged with the flywheel of the engine. Here again, tolerance stack-up of components requires use of a helical spring to ensure switch closure when the pinion shaft reaches the travel stop. This arrangement suffers from the same shortfall of abrupt application of full power to the cranking motor prematurely with regard to gear meshing. The situation wherein the pinion gear crashes into the flywheel without becoming engaged therewith has been similarly addressed by virtue of the spring between the pinion gear and pinion shaft and/or the spring within the hollow drive tube. This arrangement is also intended to allow the solenoid switch to close and apply full power to the cranking motor which rotates allowing the pinion gear to mesh with the fly wheel. Damage to gear teeth may occur with these arrangement where immediate meshing does not occur or only partial meshing occurs.

Hybrid forms of these electric starters, such as disclosed in U.S. Pat. No. 4,707,616, have a solenoid and pinion gear sharing a common axis and a cranking motor is aligned along a separate axis. The cranking motor applies rotation via in-line gearing to an over-run clutch outer portion. The clutch then imparts rotation to a clutch collar which in turn imparts rotation to a pinion shaft surrounded thereby through cooperating helical splines. The pinion shaft carries a pinion gear at the outside end. The solenoid imparts rectilinear motion to the pinion shaft to urge the shaft and pinion gear carried thereby forward through the clutch collar until it reaches a stop via a drive rod therebetween. Helical springs are located between the pinion shaft and clutch collar, between the pinion shaft and drive rod and between the solenoid plunger and a plunger stop. The solenoid plunger also carries a moving contact intended to close a switch (via a pair of stationary contacts) for application of full power to the cranking motor when the pinion gear is fully engaged with the flywheel of the engine. Once again, tolerance stack-up of components requires the use of a helical spring to ensure switch closure when the pinion shaft reaches the travel stop. This arrangement suffers from the same shortfall of abrupt application of full power to the cranking motor prematurely with regard to gear meshing. The situation wherein the pinion gear crashes into the flywheel without becoming engaged therewith has been similarly addressed by allowing the solenoid to continue its stroke by virtue of the spring between the pinion shaft and drive rod. This arrangement is also intended to allow the solenoid switch to close and apply full power to the cranking motor which rotates allowing the pinion gear to mesh with the fly wheel. Damage to gear teeth may occur with these arrangement where immediate meshing does not occur or only partial meshing occurs.

It can be seen that a multiplicity of biasing springs are utilized to counter the effects of tolerance stack-up leading to a proliferation of parts. The solenoid must be powerful enough to overcome the various spring forces which may be exerted thereon directly or through drive linkages. Additionally, the solenoid and appropriate bias springs must be able to fully mesh the pinion gear with the flywheel against the frictional forces therebetween when full power rotation is applied thereto prior to full meshing. Where the solenoid plunger has voids, such as central bores, necessitated by inclusion of springs and required attachments, the pull-in strength of the solenoid is lessened thereby and must be compensated by a larger overall plunger, larger solenoid coil or combination thereof. All of this requires combinations of large plungers, large coils, high current coils and associated space, mass and cost resulting therefrom.

Typically, true location of over-run clutches is accomplished by bearings or bushings assembled into end cavities thereof, thereby adding to clutch width and consuming axial space along the clutch collar upon which they bear. True location is desirable for minimal slop during over-run when the clutch is not driveably engaged to the clutch collar yet slidably rotates thereabout. To a great degree, the slop is dependent upon the individual tolerances and assembly of each part of the assembly (i.e. clutch collar, bearing/bushing, clutch cavities) thus requiring burdensome dimensional control.

Helical splines as described are utilized to assist full meshing when full power is applied to the cranking motor. They are shaped so as to urge the pinion gear forward when radially loaded by the cranking motor. Helical splines introduces complexity into the manufacturing process and are therefore desirably avoided.

U.S. Pat. Nos. 4,551,630 and 4,755,689, both assigned to the assignee of the present invention, show electric starters intended to energize the cranking motor at less than full speed prior to pinion gear and flywheel meshing to avoid certain of the outlined shortfalls occasioned by premature full power application. However, any of the electric starters described above may still be prone to full power application prior to full meshing due to the inherent tolerance stack-up of the components as described.

SUMMARY OF THE INVENTION

It is an object of the present invention to provide an electric starter which ensures full meshing of the pinion gear with the flywheel prior to full power application.

It is another object of the present invention to reduce the size, mass and complexity of the electric starter.

It is yet another object of the present invention to eliminate the sources of tolerance stack-up shortfalls inherent in prior art electric starters.

In accordance with the present invention, an electric starter has a coaxial pinion gear extension and drive mechanism. The mechanism has a solenoid plunger for extending the pinion gear forward through an incompressible linkage, the stroke of the plunger corresponding to the stroke of the pinion gear. The forward stroke of the pinion gear is limited by a stop provided by the solenoid, the maximum forward stroke of the pinion gear corresponding to a fully meshed pinion gear and flywheel. A pair of stationary electrical contacts provide a stop for the solenoid plunger and the plunger shunts the pair of electrical contacts when stopped thereby. During plunger forward travel, the cranking motor is caused to rotate slowly. When the plunger forward travel is limited by the pair of electrical contacts, the shunting of the contacts by the plunger causes the cranking motor to operate at full speed.

These and other advantages of this invention will be more fully understood and appreciated from the following detailed description taken together with the accompanying drawings.

DETAILED DESCRIPTION OF THE PREFERRED EMBODIMENT

Figure 1:
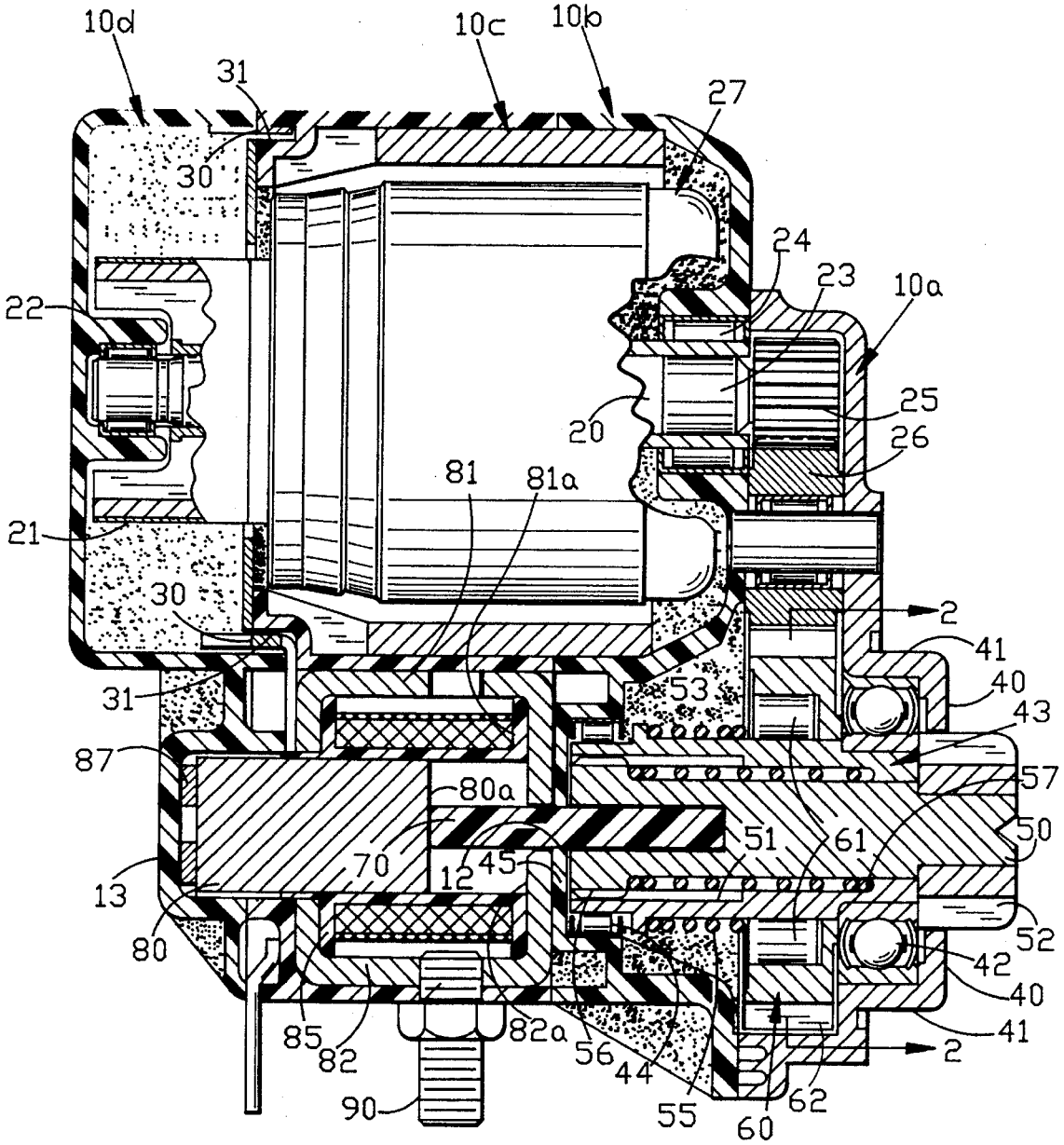
FIG.1 is a sectional view of an electric starter having a pinion gear extension and drive mechanism according to the invention.

Referring first to FIG. 1, an electric starter is shown with four housing sections; front housing 10*a*, middle housing 10*b*, rear housing 10cand commutator end housing 10*d*. Front housing 10*a* is metallic, preferably aluminum, and the remaining housing sections are plastic. A pair of through bolts (not shown) located parallel to cranking motor shaft 20 pass through all housing sections 10*a* through 10*d* to hold the assembly together along the cranking motor shaft 20 axis. Preferably, the through bolts, also aluminum, are pressed into receiving holes in front housing 10 and function as build pins during assembly and as ground paths for the cranking motor since the housing sections 10*b* through 10*c* surrounding the cranking motor are plastic. Cranking motor shaft 20 is shown with commutator end 21 rotatably supported by bearing 22 and output gear end 23 supported by bearing 24. Output gear 25 meshes with idler reduction gear 26 rotatably supported by a conventional bearing and idler pin between front housing 10*a* and middle housing 10*b*. Permanent magnets are disposed within receiving pockets formed in part in middle housing 10*b* and rear housing 10*c*. Preferably, four permanent magnets are disposed symmetrically in quadrants around the perimeter of the cranking motor armature 27 so as not to interfere with the through bolts passing through the length of the housing. Arcuate magnets form fitted to the curvature of the cranking motor armature are most desirable in consideration of effective field strength and packaging since they increase the former and decrease the latter. The receiving pockets and magnets are geometrically complementary to ensure retention therebetween in the housing sections without additional retaining means. Commutator brushes (not shown) are located within commutator end housing 10*d*, the negative commutator brushed being electrically coupled to the through bolts for a path to ground, and the positive commutator brushes being electrically coupled through an annular buss bar 30 within channel 31.

Front housing 10*a* has a substantially circular pinion gear opening defined by flange 40 extending inwardly from annular wall 41. The inner surface of annular wall 41 surrounds and houses the outer race of bearing assembly 42. The inner race of bearing assembly 42 surrounds and rotatably supports a portion of clutch collar 43 at one end thereof. The other end of clutch collar 43 is rotatably supported by bearing assembly 44 which is itself supported and housed by the inner surface of an annular wall at the back portion of middle housing 10*b*. Clutch collar 43 is axially trapped outwardly by the inner race of bearing assembly 42 at an integral step on clutch collar 43 which is diametrically larger than the adjacent portion thereof rotatably supported by bearing assembly 42. Clutch collar 43 is axially trapped inwardly by back wall 45 of middle housing 10*b*. Clutch collar 43 has a first inner diameter at the pinion gear end for surrounding pinion shaft 50 so as to allow pinion shaft 50 to axially slide therethrough and greatly limit any axial movement of pinion shaft 50 therein. A second inner diameter of clutch collar 43 begins immediately adjacent the first inner diameter supporting pinion shaft 50 and runs the remaining length of the clutch collar 43. Axial splines 51 are formed along a portion of this second inner diameter of clutch collar 43. Axial spline peaks correspond to the second inner diameter and troughs to yet a third and larger inner diameter. Clutch collar 43 further has a flange around a section thereof adjacent its rear portion supported by bearing assembly 44 which provides a back stop for compression spring 55 effective to urge clutch assembly 60 to its full forward position in alignment with reduction gear 26.

Figure 2:
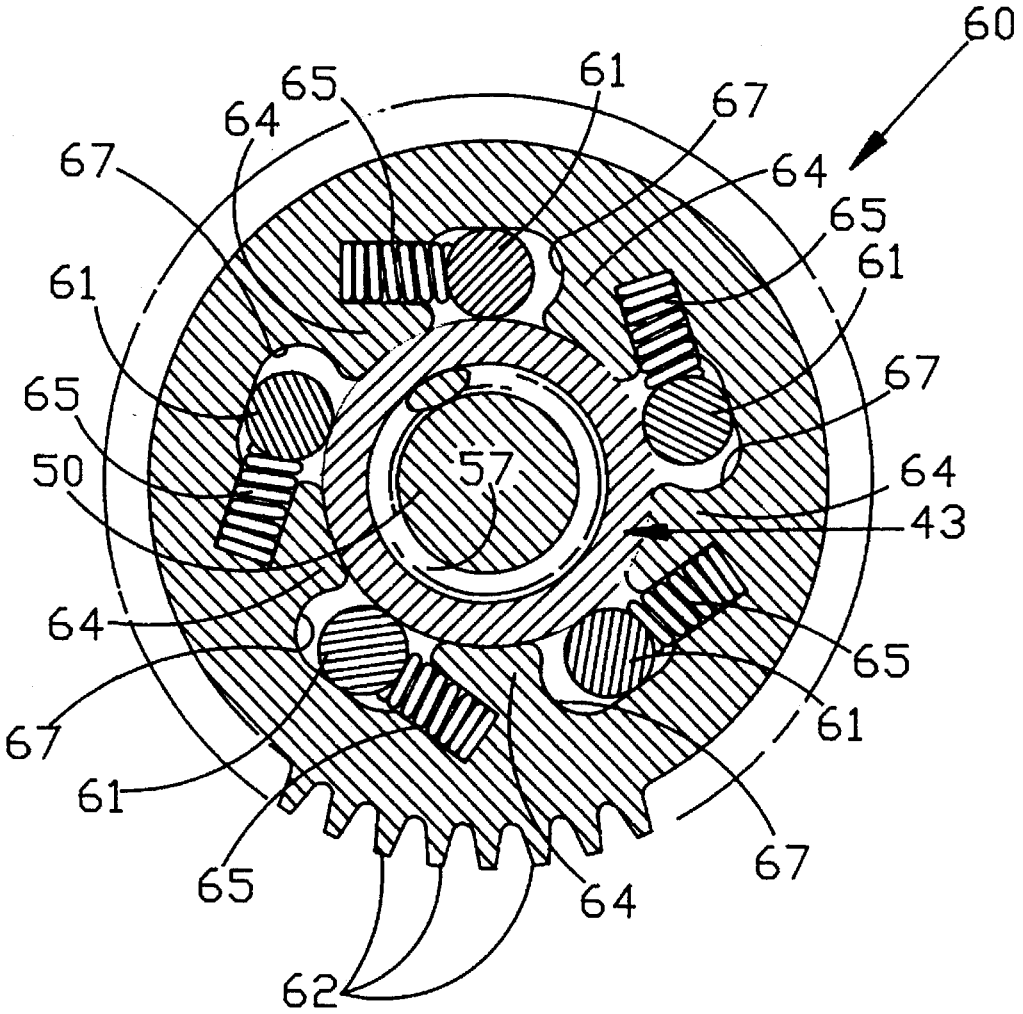
FIG. 2 is a sectional view through line 2—2 of FIG. 1 of an over-run clutch portion of a pinion gear extension and drive mechanism according to the invention.

The present embodiment advantageously minimizes space necessary to house an over-run clutch. Referring to FIG. 2 which illustrates a section view through 2—2 of FIG. 1, clutch assembly 60 has at its outer diameter drive teeth 62 for engagement with reduction gear 26. Clutch rollers 61 are biased toward one end of pockets 67 by spring 65. Pockets 67 are defined by over-run shoes which are slidably engaged with clutch collar 43. The over-run shoes are of no greater width than any other clutch element as seen in FIG. 1 thereby keeping the overall size and space requirements of the over-run clutch to a minimum. The over-run shoes provide a positive bearing surface against clutch collar 43 for smooth operation during any period of over-run.

Pinion shaft 50 has a portion thereof with an outer diameter to fit slidably within the first inner diameter of clutch collar 43 as previously described. A second portion of pinion shaft 50 at the back end thereof has a second outer diameter which conforms substantially to the third inner diameter of clutch collar 43 at the back end thereof which, as previously described, comprises the troughs of axial splines 51 thereon. Mating splines 56 on this back portion of pinion shaft 50 mate with the axial splines on the inner portion of clutch collar 43 so as to allow pinion shaft 50 to axially slide therein and yet rotate with rotation of clutch collar 43. An annular void is established radially between the outer diameter of pinion shaft 50 along a section thereof and a corresponding section of inner diameter of clutch collar 43 for inclusion of a helical spring 57 which is in compression and serves to bias pinion shaft 50 to a rearward rest position. Pinion shaft 50 further has disposed at the outer end thereof a pinion gear 52 for meshing with the internal combustion engine flywheel. Toward the rear of pinion shaft 50 is a substantially cylindrical bore on centerline of the pinion shaft for accepting push rod 70. Push rod 70 and bore 53 in pinion shaft 50 are cooperatively sized to allow pinion shaft 50 to rotate freely around push rod 70. Push rod 70 further passes through back wall 45 of middle housing **10*b* by virtue of an aperture 12 formed therein and is comprised of an electrically insulative material. Alternatively, a ball bearing (not shown) placed between the end of pushrod 70 and the bottom of bore 53 in pinion shaft 50 offers very low friction for rotation of pinion shaft 50 about pushrod 70** when urged forward thereby.

The drive solenoid assembly located immediately rearward and axially aligned with the clutch collar and pinion shaft has electrically insulative spool 85 dimensioned to slidably guide plunger 80 throughout its stroke. Push rod 70 is in contact with one end of plunger 80 so as to transfer the plunger's rectilinear motion through itself and on to pinion shaft 50. It is noted that no compressibility in the linkage comprising plunger 80, push rod 70 and pinion shaft 50 is available. Plunger 80 is comprised of a solid homogenous cross sectional magnetically permeable material such as steel. A pair of magnetically permeable spool surrounds 81 and 82 have corresponding flange portions **81*a* and 82*a* abutting back wall 45 of middle housing 10*b* to provide a forward stroke stop for plunger 80 when surface 80*a* thereof comes in contact with 81*a* and 82*a*. The combination of solid plunger 80 and magnetically permeable spool surrounds 81 and 82 advantageously provide for a minimally sized solenoid assembly. Flux is concentrated through spool surrounds 81 and 82 thereby minimizing stray flux losses, and the same is true for the solid plunger 80. The magnetic circuit established by the combination of these elements has a relatively low overall reluctance and therefore a relatively high flux density thereby allowing minimum sizing of components for any given stroke or power desired. Flange portions 81*a* and 82*a* in addition to providing forward travel stop for plunger 80 additionally provide electrical contact surfaces for plunger 80 at surface 80*a*. Spool surrounds 81 and 82 and corresponding flange portions 81*a* and 82*a* are electrically isolated at all times from plunger 80 until such time as the stroke is limited by the contacting of flanges 81*a* and 82*a* by surface 80*a*. At this point of maximum plunger stroke, spool surrounds 81 and 82 are electrically shunted and plunger 80 has reached is maximum travel thereby imparting maximum travel to pinion gear 52 through the linkage provided by push rod 70 and pinion shaft 50. Therefore, the electrical shunting of spool surrounds 81 and 82 by plunger 80 can be used to indicate full meshing of pinion gear 52 with the internal combustion engine flywheel. It is noted that since the entire stroke linkage is incompressible, shunting of spool surrounds 81 and 82 will only occur when pinion shaft and pinion gear 50 are fully extended corresponding to a full meshed position. When the solenoid is deenergized, spring 57 urges the entire linkage rearward to a rest position and plunger 80 is thereby urged against compressive back stop 87 attached to rear portion 13 of commutator housing 10*d*. Compressive backstop 87 may be comprised of open or closed cell foam material which is ideally suited in this application for taking up end play and for damping plunger return. In this embodiment, spool surround 81 is shown adjacent the cranking motor and spool surround 82 is shown adjacent to an outside wall of rear housing 10*c*. This arrangement ideally suits spool surround 81 for electrical coupling to the positive commutator brushes. Likewise, spool surround 82 is ideally suited for electrical coupling to a positive DC voltage source. Spool surround 82 has threadably engaged therewith and through an outer wall of rear housing 10*c*a battery terminal stud 90. Spool surround 81 is coupled to the positive commutator brushes via annular bus bar 30. With this arrangement, spool surrounds 81 and 82** provide a pair of electrical contacts configured with the solenoid coils to operate substantially similar to the stationary contacts disclosed in U.S. Pat. No. 4,551,630 also assigned to the assignee of the present invention.

While the invention has been exemplified in detail relating to a preferred embodiment wherein an electric engine starter is configured with an offset motor, it will be understood that the invention is not limited to that configuration solely and that alternative configurations such as coaxial motor and pinion gear drive mechanism arrangements may avail themselves to the advantages of the present invention. Accordingly, it is intended that the invention not be limited to the embodiment described but that it have the full scope permitted by the language of the appended claims.

The embodiments of the invention in which an exclusive property or privilege is claimed are defined as follows:

1. A coaxial pinion gear extension and drive mechanism for an electric starter system having a DC voltage source, a starter switch a cranking motor having an output shaft rotatable around a first axis, an over-run clutch operably coupled to and rotatable by the output shaft of said cranking motor, said mechanism comprising in combination:

a drive solenoid having pull-in and hold-in coils and solid magnetically permeable plunger, said plunger having a forward stroke along a second axis spaced apart from and parallel to said first axis, said plunger limited by a pair of electrical contacts, said plunger effective to electrically shunt said pair of electrical contacts when said forward stroke is limited thereby;

a pinion shaft mounted for rotation around said second axis having a coaxial bore at one end thereof and further having external axial splines along a portion of the outer surface radially opposite said coaxial bore and a pinion gear axially opposite said bore and splines;

communication means for causing incompressible communication between said plunger and said pinion shaft when said plunger is moved along said forward stroke, said communication means having a plunger end and a pinion shaft end, said coaxial bore of said pinion shaft disposed to accept said pinion shaft end of said communication means;

an axially static clutch collar surrounding said pinion shaft excepting said pinion gear, said clutch collar having internal axial splines along a portion of an inner surface thereof and slidably engaged with said external axial splines on said pinion shaft to allow axial movement of said pinion shaft therein and to rotatably couple said clutch collar with said pinion shaft, said clutch collar effective to impart rotational motion around said second axis from said clutch to said pinion shaft;

a helical return spring disposed intermediate a portion of said pinion shaft and a portion of said clutch collar, said return spring being trapped axially at both ends thereof and effective to bias said pinion shaft, communication means and plunger toward a deenergized rest position;

a means for operating a first mode of operation responsive to a) said starter switch being closed and b) said plunger not shunting said pair of electrical contacts wherein said pull-in coil and said cranking motor are connected in series and across said voltage source and said hold-in coil is connected is connected across said voltage source; and a means for operating a second mode of operation responsive to a) said starter switch being closed and b) said plunger shunting said pair of electrical contacts wherein said cranking motor is connected across said voltage source, said hold-in coil is connected across said voltage source and said pull-in coil is shunted by said plunger at the pair of electrical contacts;

whereby said first means of operating urges said plunger forward and energizes said cranking motor for slow rotation of said pinion gear before said forward stroke is limited and said second means of operating maintains said plunger in contact with said pair of electrical contacts at full stroke thereby energizing said cranking motor for fast rotation of said pinion gear.

2. A coaxial pinion gear extension and drive mechanism for an electric starter system as claimed in claim 1 wherein said means of incompressible communication comprises a pushrod.

3. A coaxial pinion gear extension and drive mechanism for an electric starter system as claimed in claim 1 wherein said communication means is not attached to at least one of said plunger and said pinion shaft.

4. A coaxial pinion gear extension and drive mechanism for an electric starter system as claimed in claim 3 wherein said communication means is not attached to either said plunger or said pinion shaft.

5. A coaxial pinion gear extension and drive mechanism for an electric starter system having a DC voltage source, a starter switch, a cranking motor, an over-run clutch operably coupled to the cranking motor; said mechanism comprising in combination:

a drive solenoid comprising:

pull-in and hold-in coils a solid magnetically permeable plunger, said plunger having a forward stroke limited by a pair of electrical contacts, said plunger effective to electrically shunt said pair of electrical contacts when said forward stroke is limited thereby a non-conductive spool with an inner diameter defining a substantially cylindrical plunger passage therethrough, said plunger being sized for substantially free axial movement within said plunger passage and disposed therein, said plunger having an integral contact surface at one end thereof first and second magnetically permeable spool surrounds, each of said spool surrounds having a blocking flange obstructing a portion of said passage at an end thereof corresponding to said contact surface of said plunger to limit the forward stroke of the plunger and to define a pushrod passage therebetween said blocking flanges;

a pinion shaft having a coaxial bore at one end thereof and further having external axial splines along a portion of the outer surface radially opposite said coaxial bore and a pinion gear axially opposite said bore and splines;

a pushrod having a plunger end and a pinion shaft end, said plunger end abutting said plunger, said coaxial bore of said pinion shaft disposed to accept said pinion shaft end of said pushrod;

an axially static clutch collar surrounding said pinion shaft excepting aid pinion gear, said clutch collar having internal axial splines along a portion of an inner surface thereof and slidably engaged with said external axial splines on said pinion shaft to allow axial movement of said pinion shaft therein and to rotatably couple said clutch collar with said pinion shaft, said clutch collar effective to impart rotational motion from said clutch to said pinion shaft;

a helical return spring disposed intermediate a portion of said pinion shaft and a portion of said clutch collar, said return spring being trapped axially at both ends thereof and effective to bias said pinion shaft, pushrod and plunger toward a deenergized rest position;

a means for operating a first mode of operation responsive to a) said starter switch being closed and b) said plunger not shunting said pair of electrical contact wherein said pull-in coil and said cranking motor are connected in series and across said voltage source and said hold-in coil is connected is connected across said voltage source; and a means for operating a second mode of operation responsive to a) said starter switch being closed and b) said plunger shunting said pair of electrical contacts wherein said cranking motor is connected across said voltage source, said hold-in coil is connected across said voltage source and said pull-in coil is shunted by said plunger at the pair of electrical contacts;

whereby said first means of operating urges said plunger forward and energizes said cranking motor for slow rotation of said pinion gear before said forward stroke is limited and said second means of operating maintains said plunger in contact with said pair of electrical contacts at full stroke thereby energizing said cranking motor for fast rotation of said pinion gear.

6. A coaxial pinion gear extension and drive mechanism for an electric starter system as claimed in claim 5 wherein said drive solenoid further comprises:

each of said spool surrounds having a passing flange opposite the corresponding blocking flange, both passing flanges cooperating to define a plunger passage therebetween, and said non-conductive spool having a portion thereof extending through said plunger passage to prevent contact of the plunger with either passing flange.

7. A coaxial pinion gear extension and drive mechanism for an electric starter system having a DC voltage source, a starter switch, a cranking motor, an over-run clutch operably coupled to the cranking motor, said mechanism comprising in combination:

a drive solenoid having pull-in and hold-in coils and a solid magnetically permeable plunger, said plunger having a forward stroke limited by a pair of electrical contacts, said plunger effective to electrically shunt said pair of electrical contacts when said forward stroke is limited thereby;

a pinion shaft having a coaxial bore at one end thereof and further having external axial splines along a portion of the outer surface radially opposite said coaxial bore and a pinion gear axially opposite said bore and splines;

a pushrod having a plunger end and a pinion shaft end, said pushrod being electrically non-conductive, said coaxial bore of said pinion shaft disposed to accept said pinion shaft end of said pushrod;

an axially static clutch collar surrounding said pinion shaft excepting said pinion gear, said clutch collar having internal axial splines along a portion of an inner surface thereof and slidably engaged with said external axial splines on said pinion shaft to allow axial movement of said pinion shaft therein and to rotatably couple said clutch collar with said pinion shaft, said clutch collar effective to impart rotational motion from said clutch to said pinion shaft;

a helical return spring disposed intermediate a portion of said pinion shaft and a portion of said clutch collar, said return spring being trapped axially at both ends thereof and effective to bias said pinion shaft, pushrod and plunger toward a deenergized rest position;

a means for operating a first mode of operation responsive to a) said starter switch being closed and b) said plunger not shunting said pair of electrical contacts wherein said pull-in coil and said cranking motor are connected in series and across said voltage source and said hold-in coil is connected is connected across said voltage source; and a means for operating a second mode of operation responsive to a) said starter switch being closed and b) said plunger shunting said pair of electric contacts wherein said cranking motor is connected across said voltage source, said hold-in coil is connected across said voltage source and said pull-in coil is shunted by said plunger at the pair of electrical contacts;

whereby said first means of operating urges said plunger forward and energizes said cranking motor for slow rotation of said pinion gear before said forward stroke is limited and said second means of operating maintains said plunger in contact with said pair of electrical contacts at full stroke thereby energizing said cranking motor for fast rotation of said pinion gear.

8. A coaxial pinion gear extension and drive mechanism for an electric starter system having a DC voltage source, a starter switch, a cranking motor, an over-run clutch operably coupled to the cranking motor, said over-run clutch comprising a clutch shell with external drive teeth, a plurality of clutch rollers and a plurality of over-run shoes, said over-run shoes providing a clutch collar bearing surface concentric with said clutch shell and rollers, said coaxial gear extension and drive mechanism comprising in combination:

a drive solenoid comprising pull-in and hold-in coils and a solid magnetically permeable plunger, said plunger having a forward stroke limited by a pair of electrical contacts, said plunger effective to electrically shunt said pair of electrical contacts when said forward stroke is limited thereby;

a pinion shaft having a coaxial bore at one end thereof and further having external axial splines along a portion of the outer surface radially opposite said coaxial bore and a pinion gear axially opposite said bore and splines;

a means abutting said plunger, of incompressible communication between said plunger and said pinion shaft, said communication means having a plunger end and a pinion shaft end, said coaxial bore of said pinion shaft disposed to accept said pinion shaft end of said communication means;

an axially static clutch collar surrounding said pinion shaft excepting said pinion gear, said clutch collar having internal axial splines along a portion of an inner surface thereof and slidably engaged with said external axial splines on said pinion shaft to allow axial movement of said pinion shaft therein and to rotatably couple said clutch collar with said pinion shaft, said clutch collar effective to impart rotational motion from said clutch to said pinion shaft;

a helical return spring disposed intermediate a portion of said pinion shaft and a portion of said clutch collar, said return spring being trapped axially at both ends thereof and effective to bias said pinion shaft, communication means and plunger toward a deenergized rest position;

a means for operating a first mode of operation responsive to a) said starter switch being closed and b) said plunger not shunting said pair of electrical contacts wherein said pull-in coil and said cranking motor are connected in series and across said voltage source and said hold-in coil is connected is connected across said voltage source; and a means for operating a second mode of operation responsive to a) said starter switch being closed and b) said plunger shunting said pair of electrical contacts wherein said cranking motor is connected across said voltage source, said hold-in coil is connected across said voltage source and said pull-in coil is shunted by said plunger at the pair of electrical contacts;

whereby said first means of operating urges said plunger forward and energizes said cranking motor for slow rotation of said pinion gear before said forward stroke is limited and said second means of operating maintains said plunger in contact with said pair of electrical contacts at full stroke thereby energizing said cranking motor for fast rotation of said pinion gear.

9. A coaxial pinion gear extension and drive mechanism for an electric starter system as claimed in claim 8 further comprising a helical spring surrounding a portion of said clutch collar radially opposite said internal axial splines, said helical spring being in compression between an outer flange formed on said clutch collar and said over-run clutch to urge said over-run clutch forward.

* * * * *